United States Patent [19]

Bauer et al.

[11] Patent Number: 4,508,241

[45] Date of Patent: Apr. 2, 1985

[54] SLIDABLE CLOSURE ELEMENT FOR SLIDE CLOSURES OF METALLURGICAL VESSELS

[75] Inventors: Gerhard Bauer, Moers; Eckart Hees, Dinslaken-Hiesfeld; Karl-Dieter Beckers, Neunkirchen-Seelscheid, all of Fed. Rep. of Germany

[73] Assignees: Thyssen Aktiengesellschaft vorm. August Thyssen-Hutte, Duisburg; Martin & Pagenstecher GmbH, Cologne, both of Fed. Rep. of Germany

[21] Appl. No.: 526,915

[22] Filed: Aug. 26, 1983

Related U.S. Application Data

[63] Continuation of Ser. No. 263,714, May 14, 1981, abandoned.

[30] Foreign Application Priority Data

May 17, 1980 [DE] Fed. Rep. of Germany ..... 8013402

[51] Int. Cl.[3] ..... B22D 41/08

[52] U.S. Cl. ..... 222/600; 222/561

[58] Field of Search ..... 222/600, 561, 598; 251/326

[56] References Cited

U.S. PATENT DOCUMENTS

| | | | |
|---|---|---|---|
| 3,917,130 | 11/1975 | Nigorikawa et al. | 222/600 X |
| 4,141,478 | 2/1979 | Meier | 222/600 |
| 4,187,965 | 2/1980 | Aliprandi et al. | 222/600 |
| 4,265,379 | 5/1981 | Meier | 222/600 |

FOREIGN PATENT DOCUMENTS

| | | | |
|---|---|---|---|
| 495762 | 1/1977 | Australia | 222/600 |

*Primary Examiner*—David A. Scherbel

*Attorney, Agent, or Firm*—Sprung, Horn, Kramer & Woods

[57] ABSTRACT

The invention relates to a slidable closure element for slide closures of metallurgical vessels, composed of a one-piece plate of heat resistant material which is engaged at its two opposite narrow edges by frame members that are drawn together by screws serving to tension them and hold them in contact with the edges of the plate.

26 Claims, 2 Drawing Figures

SLIDABLE CLOSURE ELEMENT FOR SLIDE CLOSURES OF METALLURGICAL VESSELS

This is a continuation of application Ser. No. 263,714 filed May 14, 1981, now abandoned.

BACKGROUND OF THE INVENTION

This invention relates to a slidable closure for slide closure of metallic vessels.

Closure elements of this type are for example known from German Allowed Application No. 2,620,423. In this construction the closure element is a plate of heat resistant material which is provided with an opening through which molten metal can pass out of the metallurgical vessel. The plate is inserted into a frame of approximately C-shaped configuration and thereafter the open side of the C is closed by placing a retaining member across it and connecting the retaining member to the frame by means of screws. The plate is guided in the frame by having its longitudinal edges bevelled and by having the frame itself provided with correspondingly configurated grooves in its longitudinal sides.

A problem with this prior art is that the manufacture of the frame is relatively expensive because it is complicated. Bevelling of the longitudinal edges of the plate themselves also requires additional operating steps and, moreover, brings with it the danger that when the plates are inserted or removed from the frame the edges may break. It is to be understood that because of the particular configuration of the known frame, it is not possible to insert or remove the plate in the plane of the frame. Rather, after the retaining member is removed from the frame the plate must first be shifted relative to the frame in the plane of the frame until the bevel longitudinal edge of the plate moves out of engagement with the corresponding groove of the frame. Thereafter, the plate must be lifted up at the opposite edge and must be removed from the frame in the direction normal to the plane of the frame. This handling during mounting or dismounting of the plate is relatively complicated and runs a considerable risk of danger to the plate which is already of rather brittle material.

SUMMARY OF THE INVENTION

Accordingly, it is an object of the present invention to overcome the disadvantages of the prior art.

A more particular object of the invention is to provide an improved slidable closure element with a slide closures of metallurgical vessels in which the frame holding the plate is of simple construction and can readily be secured to and removed from the plate without any danger of damage to the plate.

Another object is to provide a slide closure for use with such a closure element.

In keeping with these objects, and with still others which will become apparent hereafter, one feature of the invention resides in a slidable closure element for slide closures of metallurgical vessels which, briefly stated, may comprise a heat-resistant plate having two transversely spaced edges, a pair of frame members engaging the respective edges, and tensioning screws releasably connecting the frame members and drawing them into tight engagement with the edges.

Such a construction according to the present invention has a variety of advantages. First of all, the frame members are all of identical configuration. Furthermore, they can be in form of cut-offs made from commercially available profiled members, for example U-shaped profile members, and therefore can be produced simply and inexpensively. The frame accommodates itself to the configuration of the longitudinal narrow edges of the plate, i.e. engages the entire edge uniformly, so that the force with which it is pressed against the plate is to all intents and purposes uniformly distributed over the entire circumference of the plate. This means that local pressure peaks acting upon the plate are avoided. The plate itself does not require special treatment steps, such as bevelling of its edges. The mounting and dismounting are extremely simple and touching of the plate is not necessary since after the screws are released the frame members can be simply pulled away from the two sides of the plate and a new plate can be placed between them.

The invention will hereafter be described with reference to exemplary embodiments. It should be understood, however, that this is by way of example only and not to be considered limiting.

DESCRIPTION OF PREFERRED EMBODIMENTS

Figure 1:
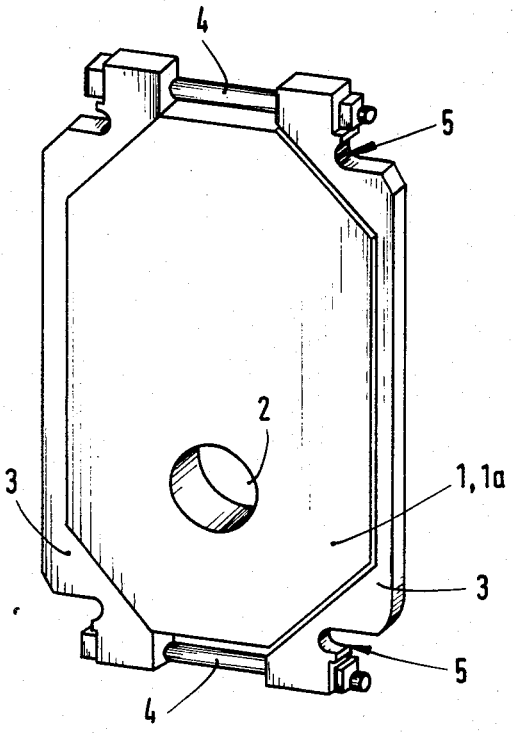
FIG. 1 is a front perspective view illustrating a slidable closure element according to the invention.
Figure 2:
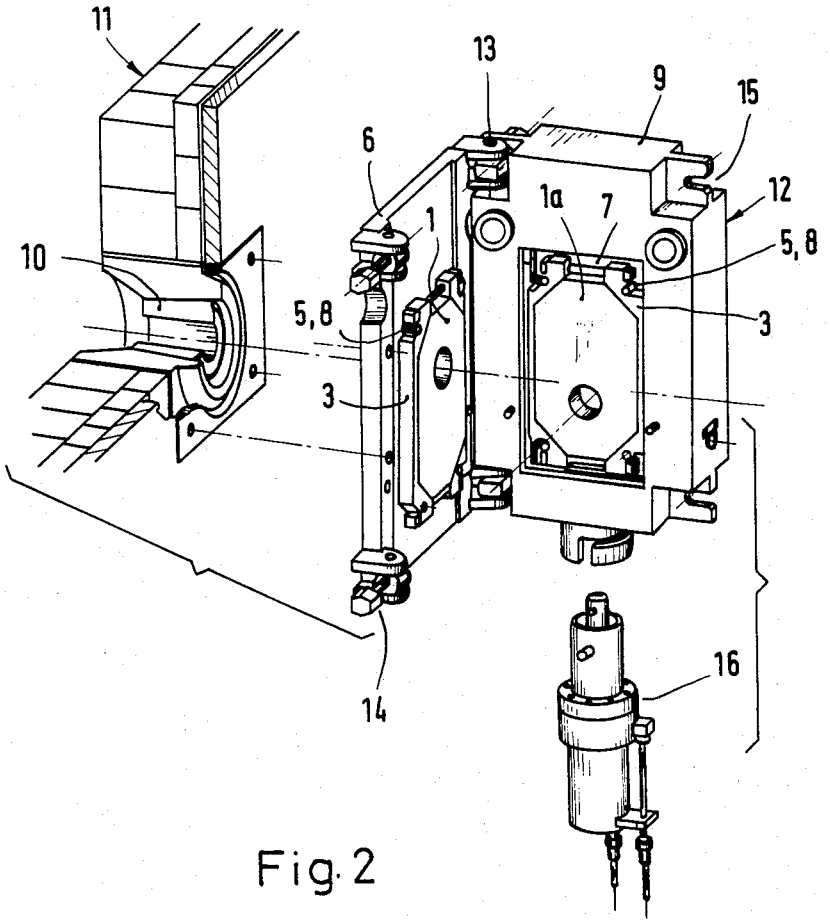
FIG. 2 is a partially exploded perspective view, showing a slide closure for use with the closure element of FIG. 1 to cover opening 10.

As shown in FIGS. 1 and 2 the head plate 1 and the slide closure plate 1*a* both are of octagonal configuration. Each plate 1, 1*a* has an opening 2 through which in the installed condition the molten metal can escape from the metallurgical vessel. Plate 1 or 1*a* has two opposite narrow sides which, since the plate here is of octagonal configuration, each have three mutually inclined facets. Each of these sides composed of the three facets is engaged by a frame member 3 configurated to tightly engage the three facets. At the opposite ends these frame members are connected by tensioning screws or bolts 4 which extend between them and secure them to each other so that they are drawn in towards one another into tight engagement with the edges of the plate 1 or 1*a*. Adjacent these opposite ends the frame members are provided with recesses 5 which will be explained subsequently.

The plate 1 or 1*a* is of refractory material, as will be evident from the fact that it is to be used in connection with metallurgical vessels.

The plate in FIG. 1 is to be used with a slide closure as shown in FIG. 2 which includes a mounting plate 6 that is connectable to the bottom of the metallurgical vessel 11. Mounted on the mounting plate 6, so that it can be pivoted to open position via a pivot arrangement 13, is the slide closure housing 9. The open position of opening 10 is shown in FIG. 2 and in this position the plates 1 or 1*a* are mounted or dismounted. When the housing 9 is moved to closed position the mounting screws 14 provided on the plate 6 extend into the associated slots 15 of the housing 9 so that the housing 9 is then held in closed position.

Mounted on the mounting plate 6 is the head plate 1, by means of locating pins 8 which extend into the recesses or slots 5 of the frame members 3. A slide carriage 7 is provided which is slidable in not illustrated guides in the housing 9 with the aid of a hydraulic cylinder 16, is also provided with locating pins 8 which extend into the slots or recesses 5 in the frame members 3 of the slide closure plate 1*a*.

The locating pins 8 provided on the mounting plate 6 and on the carriage 7 and the cooperating slots or recesses 5 on the frame members 3 of the head plate 1 and the slide closure plate 1*a* are of slightly conical configuration so that the plates 1, 1*a* can be secured without difficulty to the mounting plate 6, respectively, the carriage 7 and will be firmly seated after they are pressed in place. Moreover, the inventive slots 5 (which could be replaced by bores) together with the locating pins 8 also permit a correspondingly simple dismounting of plates 1 or 1*a* which are worn and must be replaced with new ones.

If the inventive plates 1 or 1*a* with their frame members are used in a three-plate slide closure, then a further advantage is obtained in the fact that the coupling of the hydraulic cylinder 16 which moves the center plate for opening and closing of the slide closure, can directly engage a screw bolt 4 of the slide closure plate.

It will be appreciated that the plate 1 or 1*a* could have a configuration other than octagonal, i.e. any polygonal shape, or else could be of circular or oval configuration. It is then merely necessary to accommodate the shape of the frame members 3 to the different shape of the plate so as to obtain a uniform engagement between the frame members and the plate, which is a condition for the ability to do without any sealing material (e.g. mortar) for closing the various gaps between the associated components.

The invention as hereinbefore been described with reference to particular embodiments. However, it is not to be considered limiting thereto and is defined authoritatively only in the appended claims.

What is claimed is:

1. A slidable closure element for slide closures of metallurgical vessels having pouring openings, comprising:

a refractory plate having two transversely longitudinal spaced edges and connecting transverse edges, said refractory plate having a greater longitudinal dimension than transverse dimension;

a pair of equally formed frame members for clamping therebetween longitudinal edges, said frame members being positioned and lying against opposite edges of said plate, a portion of the length of the transverse edges being unengaged by said frame members said frame members engaging tightly at least the opposed longitudinal edges of said plate, said frame members being positioned axially symmetrically when clamped relative to said plate; tensioning screws releasably connecting said frame members and drawing them into tight engagement with at least said longitudinal edges, said tensioning screws extending over said portion of said length of said transverse edges which are unengaged by said frame members.

2. The closure element of claim 1, wherein said plate is octagonal and each of said sides is composed of three mutually inclined facets which are engaged by said frame members.

3. The closure element of claim 1 or 2, wherein said frame members are provided with holes for the passage of locating pins.

4. The closure element of claim 1 or 2, wherein said frame members are provided with slots for the passage of locating pins.

5. The closure element of claim 1, wherein said plate is a head plate.

6. The closure element of claim 1, wherein said plate is a sliding plate.

7. The closure element of claim 1, in combination with a slide closure for an outlet opening of a metallurgical vessel, the slide closure having a guide, a carriage slidable in said guide and carrying said closure element, a mounting plate mountable at the bottom of the metallurgical vessel and carrying a head plate similar to said closure element, holes provided in the frame members of said closure element and head plate, and locating pins provided on said carriage and said mounting plate and engageable in said openings.

8. The closure element of claim 1, in combination with a slide closure for an outlet opening of a metallurgical vessel, the slide closure having a guide, a carriage slidable in said guide and carrying said closure element, a mounting plate mountable at the bottom of the metallurgical vessels and carrying a head plate similar to said closure element, slots provided in the frame members of said closure element and said head plate, and locating pins provided on said carriage and said mounting plate and engageable in said slots.

9. A slidable closure element according to claim 1 wherein the circumferential edges of said plate and the corresponding clamping faces of said frame members are planar.

10. A slidable closure element according to claim 1 wherein said plate has transverse edges which are parallel to one another.

11. A slidable closure element according to claim 10 wherein said plate has longitudinal edges which are parallel to one another.

12. A slidable closure element according to claim 1 wherein said frame engages all edges of said plate uniformly so that the force with which it is pressed against the plate is uniformly distributed over the entire circumference of the plate.

13. A metallurgical vessel comprising:

a bottom through which molten metal can pass out of the metallurgical vessel with a pouring opening formed therein;

a mounting plate attached to the bottom of said vessel;

a head plate mounted on said mounting plate, said head plate having a first set of locating means;

a plurality of first locating pins connected to said mounting plate for mounting said head plate;

a slide closure housing for closing said pouring opening operatively connected with said mounting plate, said slide closure housing including a carriage slidable in said slide closure housing;

a slide closure plate mounted in said slide closure housing and having a second set of locating means aligned with said first set of locating means when slide closure housing is closed onto said mounting plate;

a plurality of second locating pins connected to said slide closure housing for mounting and locating said head plate;

said head plate and said slide closure plate being made of a refractory material and having two transversely spaced edges;

a first pair of equally formed clamping frame members for clamping therebetween respective edges of said head plate and said slide closure plate;

each pair of said frame members being positioned axially symmetrically when clamped relative to said head plate;

tensioning screws releasably connecting each pair of said frame members and drawing them into tight engagement with said edges, the circumferential edges of said head plate and said slide closure plate and the corresponding clamping faces of said frame member being planar; screws on said mounting plate for engagement with screw receiving means on said slide closure housing for holding thereof in a closed position relative to said vessel bottom.

14. The metallurgical vessel as claimed in claim 13, wherein said slide closure housing and said mounting plate are pivotally connected.

15. The metallurgical vessel as claimed in claim 14, wherein said slide closure plate is of octagonal configuration having three mutually inclined facets, another frame member being configurated to engage said three facets tightly, and including tensioning screws releasably connecting said other frame members together for drawing and other frame members into tight engagement with said three mutually inclined facets.

16. A metallurgical vessel according to claim 13 wherein said metallurgical vessel has a bottom formed with a plurality of alignment openings, said mounting plate has a plurality of holes formed therein which are in alignment with said plurality of alignment openings and said slide closure housing has a plurality of protruding means which protrude through said holes of said mounting plates and into said alignment openings.

17. The metallurgical vessel as claimed in claim 16, wherein said plurality of holes are of a slightly conical configuration for reception of said third plurality of pins so that said slide closure plate and said head plate can be secured together to said vessel bottom without difficulty and said carriage is firmly seated after said plates are pressed into place.

18. The metallurgical vessel as claimed in claim 13, including an hydraulic cylinder to aid the sliding of said carriage in said slide closure housing.

19. Slide closure connected to the pouring opening in the bottom of a metallurgical vessel, comprising a mounting plate includng means for attachment thereof to the bottom of said vessel, a slide closure housing for closing said pouring opening operatively connected with said mounting plate, said slide closure housing including a carriage slidable in said slide closure housing, further comprising a refractory head plate connected to said mounting plate and a refractory slide closure plate connected to said slidable carriage and pressed upwards toward the refractory head plate, said head plate and said slide closure plate each being clamped at opposite narrow edges, each of said head plate and said slide closure plate being clamped by a pair of frame members which are detachably joined by screws, wherein said frame members are equally formed and are positioned axially symmetrically when clamped relative to said head plate and said closure plate respectively, the circumferential edges of said head plate and the corresponding faces of said frame member being planar;

said frame members having receiving means for receiving locating pins;

a plurality of first locating pins connected to said mounting plate and passing through said receiving means in said head plate , thereby mounting said head plate to said mounting plate;

a plurality of second locating pins connected to said slidable carriage and passing through said receiving means in said slide closure plate , thereby mounting said slide closure plate to said slidable carriage.

20. Slide closure as claimed in claim 19, wherein said head plate and said slide closure plate each are of octagonal configuration, each of said frame members being configurated to engage three facets of said plate tightly.

21. Slide closure as claimed in claim 20, wherein said plurality of first locating pins connected to said mounting plate and said plurality of second locating pins connected to said slidable carriage and the cooperating receiving means on the frame members of the head plate and the slide closure plate are of slightly conical configuration.

22. Slide closure as claimed in claim 19, wherein said plurality of first locating pins connected to said mounting plate and said plurality of second locating pins connected to said slidable carriage and the cooperating receiving means on the frame members of the head plate and the slide closure plate are of slightly conical configuration.

23. A slide closure according to claim 19 wherein receiving means of said frame members comprises at least one hole.

24. A slide closure according to claim 19 wherein said receiving means of said frame members comprise at least one recess.

25. A slide closure connected to the pouring opening in the bottom of a metallurgical vessel, comprising a mounting plate including means for attachment thereof to the bottom of said vessel, a slide closure housing for closing said pouring opening operatively connected to said mounting plate, said slide closure housing including a carriage slidable in said slide closure housing, further comprising a refractory head plate connected to said mounting plate and a refractory slide closure plate connected to said slidable carriage, each of said head plate and said slide closure plate having two transversely spaced longitudinal edges and connecting transverse edges, each of said head plate and said slide closure plate having a greater longitudinal dimension than transverse dimension, each of said plates having a pair of equally formed frame members for clamping therebetween said longitudinal edges, said frame members being positioned and lying against opposite edges of the respective plates, a portion of the length of the transverse edges of both of said plates being unengaged by said frame members, said frame members engaging tightly at least the opposite longitudinal edges of the respective plates, said frame members being positioned axially symmetrically when clamped relative to said plates and tensioning screws releasably connecting said frame members and drawing them into tight engagement with said edges, said tensioning screws extending over said portion of said length of said transverse edges which are unengaged by said frame members.

26. A slide closure according to claim 25 wherein the circumferential edges of each of said refractory head plate and said slide closure plate and the corresponding clamping faces of the respective frame members are planar.

* * * * *